US008172654B2

(12) United States Patent
String

(10) Patent No.: US 8,172,654 B2
(45) Date of Patent: May 8, 2012

(54) COIN PROCESSING MACHINE WITH PIVOTING ALIGNMENT FINGER

(76) Inventor: Gregory F. String, Mechanicsburg, PA (US)

( * ) Notice: Subject to any disclaimer, the term of this patent is extended or adjusted under 35 U.S.C. 154(b) by 351 days.

(21) Appl. No.: 12/104,119

(22) Filed: Apr. 16, 2008

(65) Prior Publication Data

US 2009/0191801 A1 Jul. 30, 2009

Related U.S. Application Data

(60) Provisional application No. 60/912,022, filed on Apr. 16, 2007.

(51) Int. Cl.
*G07D 1/00* (2006.01)

(52) U.S. Cl. ..... 453/6

(58) Field of Classification Search ..... 453/6, 48, 453/50–54, 18, 33–35, 49, 57; 194/293, 194/300; 221/7, 174, 208, 231, 251, 267; 209/601, 602, 604
See application file for complete search history.

(56) References Cited

U.S. PATENT DOCUMENTS 2,437,721 A * 3/1948 Barganz et al. ..... 453/35
4,178,502 A 12/1979 Zimmermann
4,752,274 A * 6/1988 Abe ..... 453/32
4,904,223 A * 2/1990 Sentoku ..... 453/7
5,046,989 A * 9/1991 Dass ..... 453/17
5,170,874 A * 12/1992 Abe ..... 194/344
5,484,334 A * 1/1996 Evdokimo ..... 453/3
5,525,104 A 6/1996 Adams et al.
5,551,911 A 9/1996 Rumbach
5,992,602 A 11/1999 Zwieg et al.
6,039,644 A 3/2000 Geib et al.
6,350,192 B1 * 2/2002 Kibihara ..... 453/50

FOREIGN PATENT DOCUMENTS

EP 0266021 B1 4/1992

OTHER PUBLICATIONS

Written Opinion of the International Searching Authority, corresponding PCT/US2009/040418, Dec. 2, 2009.

* cited by examiner

*Primary Examiner* — Mark Beauchaine
(74) *Attorney, Agent, or Firm* — Hooker & Habib, P.C.

(57) ABSTRACT

A coin processing machine includes a first stationary finger and a second stationary finger spaced from the first stationary finger and defining a first opening between them to receive a stream of singulated coins. The first opening is larger than the largest diameter coin to be processed by the coin processing machine. A movable third finger is spaced from the first finger and defines a second opening downstream from the first opening. Larger-diameter coins move the third finger to permit the coins to move through the second opening and past the third finger. Smaller-diameter coins that pass through the first opening and engage the third finger are directed towards the first finger before reaching and passing through the second opening.

14 Claims, 2 Drawing Sheets

COIN PROCESSING MACHINE WITH PIVOTING ALIGNMENT FINGER

This application claims priority to my provisional patent application No. 60/912,022 filed Apr. 16, 2007 and titled "Coin Processing Machine with Pivoting Alignment Finger", which provisional application is incorporated by reference as if fully set forth herein.

FIELD OF THE INVENTION

The invention relates to coin processing machines for sorting, counting, or verifying coins or like tokens.

BACKGROUND OF THE INVENTION

FIG. 3 illustrates in part a known coin processing machine 10. The coin processing machine 10 has proven in practice to be a reliable and durable device that accurately sorts, counts, or verifies coins at high speed.

Coin processing machine 10 has a rotatable turntable 12 mounted in stationary plate 14. Turntable 12 has an upper coin support surface 16 flush with upper coin support surface 18 of plate 14.

Stationary raking finger 20 and stationary guide finger 22 are mounted on plate 14. Raking finger 20 and guide finger 22 define a first opening 24 that receives a singulated stream of coins from turntable 12. A raised peripheral wall (not shown) mounted to plate 14 partially surrounds the turntable 12 and has an opening aligned with opening 24 to enable coins leaving turntable 14 to move between fingers 20 and 22.

A belt drive 27 has a belt run 29 located above plate 14. The belt run 29 engages coins entering opening 24 and accelerates the coins towards coin through-slot 26 formed in plate 14. The belt drive 27 spaces the coins apart as the coins move towards slot 26 as is described in my U.S. patent application Ser. No. 11/032,718 filed Jan. 11, 2005, which application is incorporated by reference as if fully set forth herein. The belt run 29 urges the coins towards a first, planar guide surface 28 of guide finger 22 (that is, the belt run 29 does not extend parallel with guide surface 28 but extends towards surface 28 as the belt run extends towards slot 26).

Sensors 30 carried in plate 14 are located between opening 24 and slot 26. Sensors 30 are also described in my '718 application and so are not described in detail here. Each sensor 30 is associated with a different diameter coin and is spaced a predetermined distance from guide surface 28. The sensors are arranged to first detect the largest diameter coin (in the illustrated embodiment a US half-dollar piece) and then detect each succeeding smaller-diameter coin as a coin in contact with guide surface 28 passes sensors 30. The sensors 30 are connected to a controller (not shown) that records the denomination of each coin passing the sensors 30 and maintains a running count of the value of the coins discharged from turntable 12.

In operation, a stream of coins is discharged from the turntable 12 and move through opening 24. Opening 24 is sized such that the largest diameter coin of the coin or currency used with the machine is closely received within the opening. The illustrated opening 24 is sized to closely receive a US half-dollar coin. Opening 24 is preferably approximately 0.005 inches to 0.05 inches larger than the diameter of the half-dollar coin.

Larger-diameter coins such as half-dollar coins or quarter-dollar coins contact nose 32 of guide finger 22 as the coin passes through opening 24. The belt rotates or pivots the coin about opening 24 as the coin is driven along guide finger 22 to slot 26. This assures that the edge of the coin maintains contact with guide surface 28 as the coin moves along guide finger 22. The coin is properly aligned against guide surface 28 as the coin passes sensors 30 for accurate discrimination and counting of the coin.

Smaller-diameter coins such as US-currency nickels, dimes, and pennies may pass through opening 24 without contacting raking finger 20 or guide finger 22. The belt urges a smaller-diameter coin towards guide surface 28 as the coin moves towards slot 26. Even before contacting guide surface 28, the coin is sufficiently close to surface 28 that the coin does not pass over the sensors 30 associated with the larger diameter coins. The coin contacts and abuts guide surface 28 before passing over the sensor 30 corresponding to its coin denomination for accurate discrimination and counting of the coin.

It has been observed, however, that sensors 30 may miscount some smaller-diameter coins if the coins are wet or oily. It is believed that the moisture or oil acts as a lubricant that reduces friction between the belt and the coin. The reduced friction is believed to prevent the belt from reliably moving smaller-diameter coins that enter the opening 24 while relatively close to the raking finger 20 against the guide surface 28 before reaching the sensors 30. Such smaller-diameter coins may remain away from guide surface 28 and pass over the upstream sensors intended to sense only larger-diameter coins. As a result, the coin is mistakenly sensed and counted as a larger denomination coin.

Thus there is a need to improve the coin machine 10 and its equivalents for more accurate processing of wet or oily coins.

SUMMARY OF THE INVENTION

The invention is an improvement to the coin machine 10 and its equivalents that more accurately processes wet or oily coins. The improvement more reliably aligns the flow of coins with respect to the guide surface.

The improved coin processing machine of the present invention includes a third finger or alignment finger located in the downstream direction along the first guide surface from the first finger. The third finger is spaced from the first guide surface and defines a second opening between itself and the first guide surface downstream from the first opening. The third finger is normally located in a position such that the second opening is smaller than the smallest diameter of the larger coins and larger than the largest diameter of the smaller coins. The third finger is movable away from the first guide surface.

When a larger-diameter coin moves downstream through the first opening and reaches the second opening, the larger-diameter coin engages the third finger in its normal position. Continued downstream movement of the coin moves the third finger away from the first guide surface towards a retracted position that allows the larger-diameter coin to pass through the second opening and past the third finger. The third finger returns to its normal position after the larger-diameter coin passes by and before any smaller-diameter coin can pass through the second opening.

When a smaller-diameter coin moves downstream through the first opening to the second opening, some of the smaller-diameter coins engage the third finger. The third finger has a second guide surface that faces the first opening and preferably extends in a downstream direction towards the first guide surface. Smaller-diameter coins that engage the second guide surface are directed towards the first guide surface as they move downstream to the second opening. The smaller-diameter coins are thus moved closer to the first guide surface before passing through the second opening so that the belt reliably moves the coins against the first guide surface before the coins reach the sensors.

Other objects and features of the invention will become apparent as the description proceeds, especially when taken in conjunction with the accompanying drawing sheet illustrating an embodiment of the invention.

DESCRIPTION OF THE PREFERRED EMBODIMENT

Figures 1, 2:
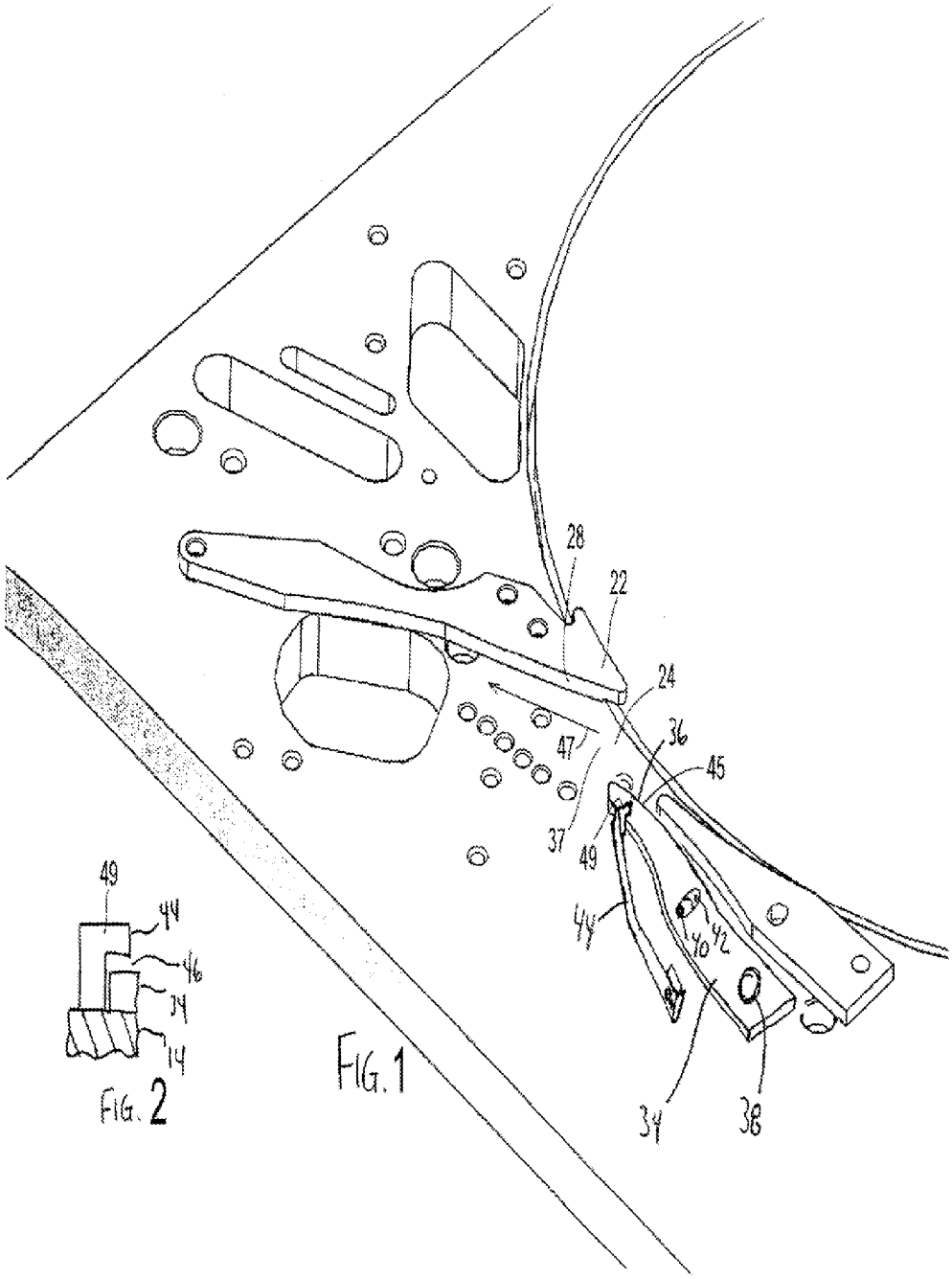
FIG. 1 is a top perspective view of a portion of a coin processing machine in accordance with the present invention.
FIG. 2 is a partial sectional view illustrating an enlarged portion of the coin processing machine shown in FIG. 1.
Figure 3:
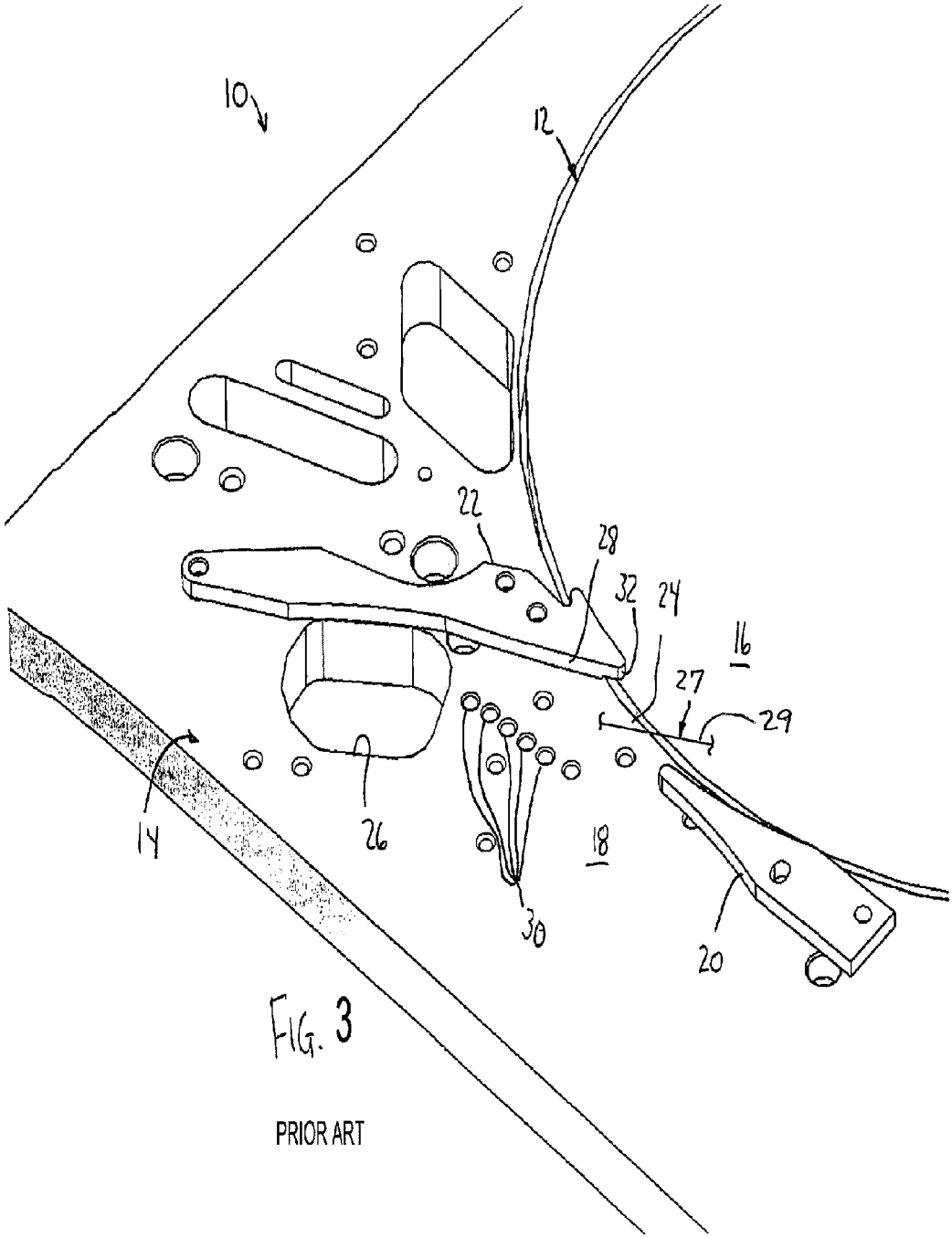
FIG. 3 PRIOR ART
FIG. 3 is a top perspective view of a portion of a conventional coin processing machine.

FIG. 1 illustrates machine 10 modified per the present invention. Only the modifications are discussed, it being understood the other unmodified component parts described above of the machine 10 remain as previously described.

A pivotable alignment finger 34 is mounted on plate 14 downstream from rake finger 20. Alignment finger 34 has a free end 36 that is spaced away from the first guide surface 28. The alignment finger 34 and the guide surface 28 define a second opening 37 that is downstream from the first opening 24 along the guide surface 28.

Alignment finger 34 pivots about mounting fastener 38. The range of motion of finger 34 is established by dowel pin 40 in circumferentially-elongate finger slot 42 between a normal operating position towards rake finger 20 and a retracted position away from rake finger 20. A spring 44 formed from thin spring steel plate engages finger 34 and urges the free end 36 of finger 34 towards the normal operating position.

Free end 36 of finger 34 extends sufficiently towards the first opening 24 to contact and engage larger-diameter coins passing through the opening as the coins move along guide surface 28. In other words, the width of the second opening 37 is less than the largest diameter of coin to be processed. Free end 36 includes a guide surface 45 that faces the first opening 24. Guide surface 45 extends in a downstream direction towards the first guide surface 28.

When a larger-diameter coin passes through first opening 24, the coin contacts end 36 of finger 34 as it bears against guide surface 28. The lower belt run (represented schematically as arrow 47) forces the coin past alignment finger 34, deflecting spring 44 and moving the alignment finger 34 towards its retracted position. Movement of the alignment finger 34 enables the coin to continue moving through second opening 37 and pass by the finger end 36. Spring 44 urges the alignment finger quickly back to its normal position after the coin passes the alignment finger 34.

When a smaller-diameter coin passes through first opening 24 the alignment finger 34 is in its normal operating position as shown in FIG. 1. A smaller-diameter coin that is located closer to the raking finger 20 than the guide finger 22 may engage second guide surface 45 of the alignment finger 34 after the coin moves through the opening 24. Second guide surface 45 is configured to redirect the coin towards first guide surface 28 as the belt forces the coin downstream towards the second opening 37. The smaller-diameter coin has a diameter less than the opening 37 (that is, the smaller-diameter coin has a diameter less than the distance between finger 34 and guide surface 28 when the finger 34 is in its normal position).

The smaller-diameter coin is not compressed between finger 34 and guide surface 28 when it reaches the end of the guide surface 45 and enters the second opening 37, and so the smaller-diameter coin does not force the finger 34 away from its normal operating position. After the smaller-diameter coin passes finger 34, the belt continues the component of coin travel towards guide surface 28 to assure that the coin engages the guide surface 28 before reaching the sensors 30 for accurate discrimination and counting.

When a smaller-diameter coin is away from the raking finger 22 when passing through first opening 24, the coin may not engage finger 34. The coin, however, is sufficiently close to guide surface 28 that the belt will properly align the coin with respect to surface 28 before the coin reaches sensors 30.

If a larger-diameter coin is followed by a smaller-diameter coin, the spring 44 moves alignment finger 34 back to its normal position quickly so that the smaller-diameter coin may engage the guide surface 45 and be directed towards the guide surface 28 before the smaller-diameter coin reaches the second opening 37. Preferably the guide surface 45 extends towards the first guide surface 28 even when the alignment finger 34 has not yet returned to its normal position.

Alignment finger 34 is preferably mounted on plate 14 with a small amount of vertical play 46 (see FIG. 2) that enables the finger to move towards and away plate 14. The amount of play must be less than the minimum coin thickness, and is intended to enable dirt and other contaminants to pass under finger 34 without buildup. Spring 44 has an upper portion 49 that extends above and overhangs finger 34 with sufficient clearance to enable the desired vertical play. After lifting off plate 14, the upper surface of finger 34 engages the overhanging spring portion 49 to prevent further vertical movement of the finger.

The improved coin processing machine reliably counted wet or oily coins when tested.

It should be understood that although the invention is described in relation to US denomination coins, this is not limiting and the invention can be readily adapted for use with coin denominations of other countries.

While I have illustrated and described a preferred embodiment of my invention, it is understood that this is capable of modification, and I therefore do not wish to be limited to the precise details set forth, but desire to avail myself of such changes and alterations as fall within the purview of the following claims.

What I claim as my invention is:

1. In a coin processing machine for processing coins of varying diameters, the coins comprising a first set of larger diameter coins and a second set of smaller diameter coins, the coin processing machine of the type having means for discharging a singulated stream of coins to be processed onto a flat surface, a side of each coin against the flat surface, a first stationary finger above the flat surface and a second stationary finger above the flat surface, the first stationary finger spaced from the second stationary finger and defining a first opening between them located to receive the stream of singulated coins on the flat surface, the first opening larger than the largest diameter coin of the coins to be processed by the coin processing machine, the second stationary finger comprising a first guide surface that extends from the first opening in a downstream direction to abut and guide coins received through the opening in the downstream direction, coins abutting against the first guide surface supported solely on the flat surface, and a belt run above the flat surface, the belt run engaging the coins and driving the coins through the first opening, the improvement comprising:

a third finger over the flat surface and spaced from the first guide surface, the third finger in a normal operating position wherein the third finger and the first guide surface define between them a second opening downstream from the first opening to receive the stream of singulated coins on the flat surface, the second opening smaller than the first opening;

the third finger movably mounted on the flat surface and movable from the normal operating position away from the first guide surface to a second operating position, the third finger biased towards the normal operating position, the size of the second opening increasing as the third finger moves from the normal operating position to the second operating position;

the third finger comprising a second guide surface facing the first opening when the third finger is in the normal position, the second guide surface extending in a downstream direction towards the first guide surface when the third finger is in the normal position; and the flat surface being underneath the entire third finger for all positions of the third finger, the flat surface extending without interruption from the third finger to the first guide surface whereby said side of a coin located between the third finger and the first guide surface contacts only the flat surface.

2. The coin processing machine of claim 1 wherein the second guide surface extends in the downstream direction towards the first guide surface when the third finger is in the second operating position.

3. The coin processing machine of claim 1 comprising spring means for biasing the third finger towards the normal operating position.

4. The coin processing machine of claim 1 wherein the third finger is pivotable about an axis for movement between the normal and second operating positions.

5. The coin processing machine of claim 4 comprising an elongate slot in the third finger and a stop member in the slot to limit movement of the third finger.

6. The coin processing machine of claim 1 wherein the flat surface represents a horizontal surface and the coin processing machine comprises a connection mounting the third finger for vertical movement with respect to the horizontal surface.

7. The coin processing machine of claim 6 wherein the third finger is located vertically between two members that limit vertical movement of the third finger.

8. The coin processing machine of claim 7 wherein one of the two members comprises a spring urging the third finger towards the normal operating position.

9. The coin processing machine of claim 1 comprising a turntable that normally rotates in a direction of rotation, the first guide surface circumferentially spaced from the third finger with respect to the axis of rotation.

10. A method of aligning the flow of a stream of singulated coins on a flat surface with respect to a stationary guide surface extending in a downstream direction along the flat surface, the coins comprising a first set of larger diameter coins and a second set of smaller diameter coins, the method comprising the steps of:

(a) driving the flow of coins on the flat surface through a first opening utilizing a belt drive that engages and drives the coins through the first opening;

(b) flowing the coins passing through the first opening along the first stationary guide surface extending from the first opening in a downstream direction, the first opening larger than the diameter of the largest coin, the coins supported solely on the flat surface when moving through the first opening and along the first stationary guide surface;

(c) flowing the coins on the flat surface between a movable member and the first stationary guide surface downstream from the first opening, the member movable over the flat surface away from the first guide surface from the normal position towards a retracted position, the member and the first guide surface defining a second opening between them, the second opening smaller than the smallest diameter of the larger-diameter coins but larger than the largest diameter of the smaller-diameter coins when the member is in its normal position;

(d) moving the member from the normal position towards the retracted position in response to each larger-diameter coin engaging the member as the larger-diameter coin moves downstream on the flat surface from the first opening and allowing the larger-diameter coin to move on the flat surface past the member as the larger-diameter coin moves along the first guide surface and returning the member to the normal position before a subsequent smaller-diameter coin on the flat surface reaches the second opening;

(e) guiding each of the smaller-diameter coins moving on the flat surface that engage the member after passing through the first opening towards the first guide surface as the smaller-diameter coin moves downstream towards the second opening and passing the smaller-diameter coin through the second opening while the member is in the normal position.

11. The method of claim 10 wherein step (d) comprises the step of:

(f) pivotally moving the member towards and away from the normal position.

12. The method of claim 10 wherein step (d) comprises the step of:

(f) continuously urging the member towards the normal position.

13. The method of claim 10 wherein the stream of coins define a horizontal plane, the method further comprising the step of:

(f) moving the member vertically to permit dirt or debris moving downstream with the stream of coins to pass beneath the member.

14. In a coin processing machine for processing coins of varying diameters, the coins comprising a first set of larger diameter coins and a second set of smaller diameter coins, the coin processing machine of the type having means for discharging a singulated stream of coins to be processed onto a flat surface, a side of each coin against the flat surface, a first stationary finger above the flat surface and a second stationary finger above the flat surface, the first stationary finger spaced from the second stationary finger and defining a first opening between them located to receive the stream of singulated coins on the flat surface, the first opening larger than the largest diameter coin of the coins to be processed by the coin processing machine, the second stationary finger comprising a first guide surface that extends from the first opening in a downstream direction to abut and guide coins received through the opening in the downstream direction, coins abutting against the first guide surface supported solely on the flat surface, the improvement comprising:

a third finger over the flat surface and spaced from the first guide surface, the third finger in a normal operating position wherein the third finger and the first guide surface define between them a second opening downstream from the first opening to receive the stream of singulated coins on the flat surface, the second opening smaller than the first opening;

the third finger movably mounted on the flat surface and movable from the normal operating position away from the first guide surface to a second operating position, the third finger biased towards the normal operating position, the size of the second opening increasing as the third finger moves from the normal operating position to the second operating position;

the third finger comprising a second guide surface facing the first opening when the third finger is in the normal position, the second guide surface extending in a downstream direction towards the first guide surface when the third finger is in the normal position;

the flat surface being underneath the entire third finger for all positions of the third finger, the flat surface extending without interruption from the third finger to the first guide surface whereby said side of a coin located between the third finger and the first guide surface contacts only the flat surface;

the flat surface representing a horizontal surface and the coin processing machine further comprising a connection mounting the third finger for vertical movement with respect to the horizontal surface, the third finger located vertically between two members that limit vertical movement of the third finger; and one of the two members comprises a spring urging the third finger towards the normal operating position.

* * * * *